US005961350A

United States Patent [19]

Shiu

[11] Patent Number: 5,961,350

[45] Date of Patent: Oct. 5, 1999

[54] MODULAR SIDE-BY-SIDE CONNECTORS

[75] Inventor: Leung Man Shiu, N. Potomac, Md.

[73] Assignee: The Whitaker Corporation, Wilmington, Del.

[21] Appl. No.: 09/124,147

[22] Filed: Jul. 28, 1998

Related U.S. Application Data

[60] Provisional application No. 60/054,374, Jul. 31, 1997.

[51] Int. Cl.[6] ..... H01R 13/643

[52] U.S. Cl. ..... 439/607; 439/108

[58] Field of Search ..... 439/607, 608, 439/609, 610, 544, 540, 540.1, 717, 590, 594, 108

[56] References Cited

U.S. PATENT DOCUMENTS

| | | | |
|---|---|---|---|
| 4,451,107 | 5/1984 | Dola et al. | 339/143 R |
| 4,623,211 | 11/1986 | Dambach et al. | 439/607 |
| 4,820,169 | 4/1989 | Weber et al. | 439/65 |
| 4,842,554 | 6/1989 | Cosmos et al. | 439/609 |
| 4,990,094 | 2/1991 | Chandler et al. | 439/108 |
| 5,030,140 | 7/1991 | Sugiyama | 439/607 |
| 5,035,651 | 7/1991 | Dixon et al. | 439/609 |
| 5,037,330 | 8/1991 | Fulponi et al. | 439/607 |
| 5,083,945 | 1/1992 | Miskin et al. | 439/607 |
| 5,161,997 | 11/1992 | Defibaugh et al. | 439/532 |
| 5,167,531 | 12/1992 | Broschard, III et al. | 439/540 |
| 5,207,597 | 5/1993 | Kline et al. | 439/607 |
| 5,376,011 | 12/1994 | Rudy, Jr. et al. | 439/79 |
| 5,429,520 | 7/1995 | Morlion et al. | 439/108 |
| 5,443,392 | 8/1995 | Longueville et al. | 439/108 |
| 5,496,195 | 3/1996 | Reed | 439/607 |
| 5,637,015 | 6/1997 | Tan et al. | 439/607 |
| 5,686,739 | 11/1997 | Davis et al. | 439/607 |
| 5,766,041 | 6/1998 | Morin et al. | 439/609 |
| 5,788,538 | 8/1998 | Belopolsky et al. | 439/607 |
| 5,797,770 | 8/1998 | Davis et al. | 439/607 |

FOREIGN PATENT DOCUMENTS

| | | | |
|---|---|---|---|
| 0 670 616 A1 | 9/1995 | European Pat. Off. | H01R 23/68 |

*Primary Examiner*—Paula Bradley
*Assistant Examiner*—Alexander Gilman
*Attorney, Agent, or Firm*—Anton P. Ness

[57] ABSTRACT

A side-by-side arrangement (18) of at least two shielded connectors (20,22) interlocked to each other and manipulatable as a unit. Board-mounting legs (40,42) of adjacent shield side walls (52,54) are insertable in pairs into common mounting holes (16) of circuit board (12) to define a closely spaced arrangement (10). The connector shields (44,46) interlock with a locking tab (56,64) of a shield side wall (52,54) of each received into a tab-receiving pocket (60,66) of a shield side wall (54,52) of the other.

14 Claims, 4 Drawing Sheets

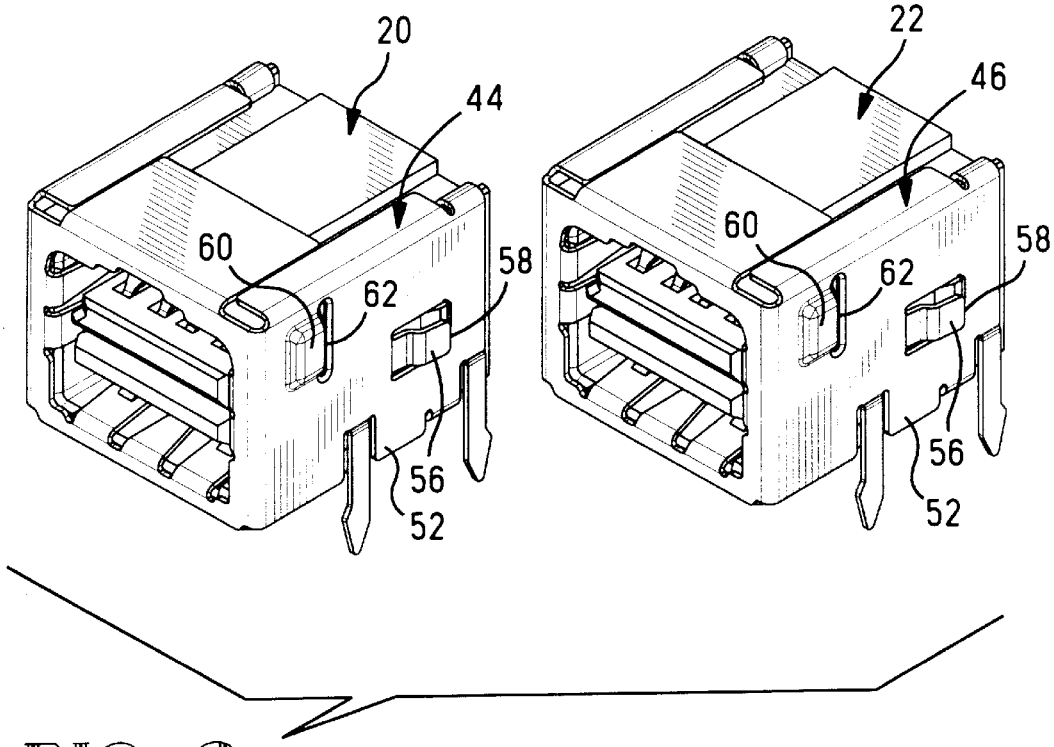
FIG. 3
FIG. 4
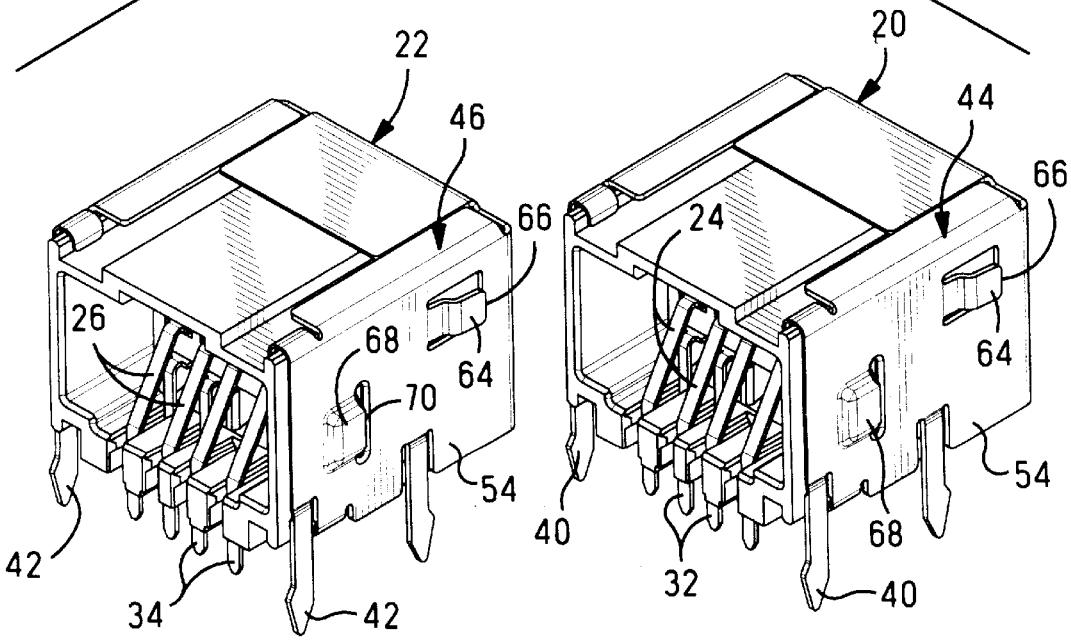

MODULAR SIDE-BY-SIDE CONNECTORS

This application claims the benefit of provisional application 60/054,374, filed Jul. 31, 1997.

FIELD OF THE INVENTION

This relates to the field of electrical connectors and more particularly to shielded connectors.

BACKGROUND OF THE CONNECTORS

Connectors for use in computers are known to have shields surrounding the housing except at those areas where access to contacts is provided, so that much protection is provided against electromagnetic and radiofrequency interference (EMI/RFI). Some shielded connectors are mounted onto circuit boards and positioned at input/output port openings in the computer outer housing such that the connector is at least adjacent the housing wall and the connector mating face is aligned with the opening for mating with a mating connector of peripheral equipment. One such connector is a Universal Serial Bus (USB) stacked receptacle connector sold by AMP Incorporated, Harrisburg, Pa. under Part Nos. 787617-1 and -2 and is matable with a pair of plug connectors terminated onto cable ends.

It is desired to provide a shielded input/output receptacle connector that is adapted to be closely spaced side-by-side with other like connectors to define an array.

SUMMARY OF THE INVENTION

The present invention provides a shielded connector that is adapted to be placed adjacent and against another like shielded connector, and mounted onto a circuit board.

In one aspect of the invention, the board-mount legs along one side of the connector shield of one of the connectors are adapted to be inserted into corresponding holes of the circuit board alongside the board-mount legs of the shield of the adjacent connector. The legs are planar and aligned parallel to the side of the shield and offset incrementally outwardly from the shield side wall, so that two such legs may coextend alongside each other and against each other. Preferably board retention protrusions of the legs extend from side edges of the legs to interfere with the hole walls after insertion therethrough as a temporary board retention until soldering of the connector contacts and the shield legs to circuits of the board.

In another aspect of the invention, the shield is adapted to interlock with the shield of the adjacent connector, whereby the array of connectors may be assembled together side-by-side without additional fastening devices, to be handled as a unit to facilitate assembly to the circuit board. Each shield side wall includes both a tab extending parallel to the side wall and offset outwardly a slight distance, and a tab-receiving pocket. The pocket includes an entrance into which a tab of an adjacent shield is insertable during assembly, and within which the tab is preferably secured in a friction fit. The tab and pocket of one of the shield side walls may have vertically and horizontally staggered locations, with the tab extending, and the pocket entrance facing, both either forwardly or rearwardly; and the tab and pocket of the opposite side wall located reversely, extending and facing the opposite direction from those of the one side wall; the shield is thus interlockable with an identical shield.

An embodiment of the present invention will now be described by way of example with reference to the accompanying drawings.

BRIEF DESCRIPTION OF THE DRAWINGS

FIGS. 3 and 4 are isometric front and rear views of the connectors of FIGS. 1 and 2 separated from each other;

DETAILED DESCRIPTION

Figure 1:
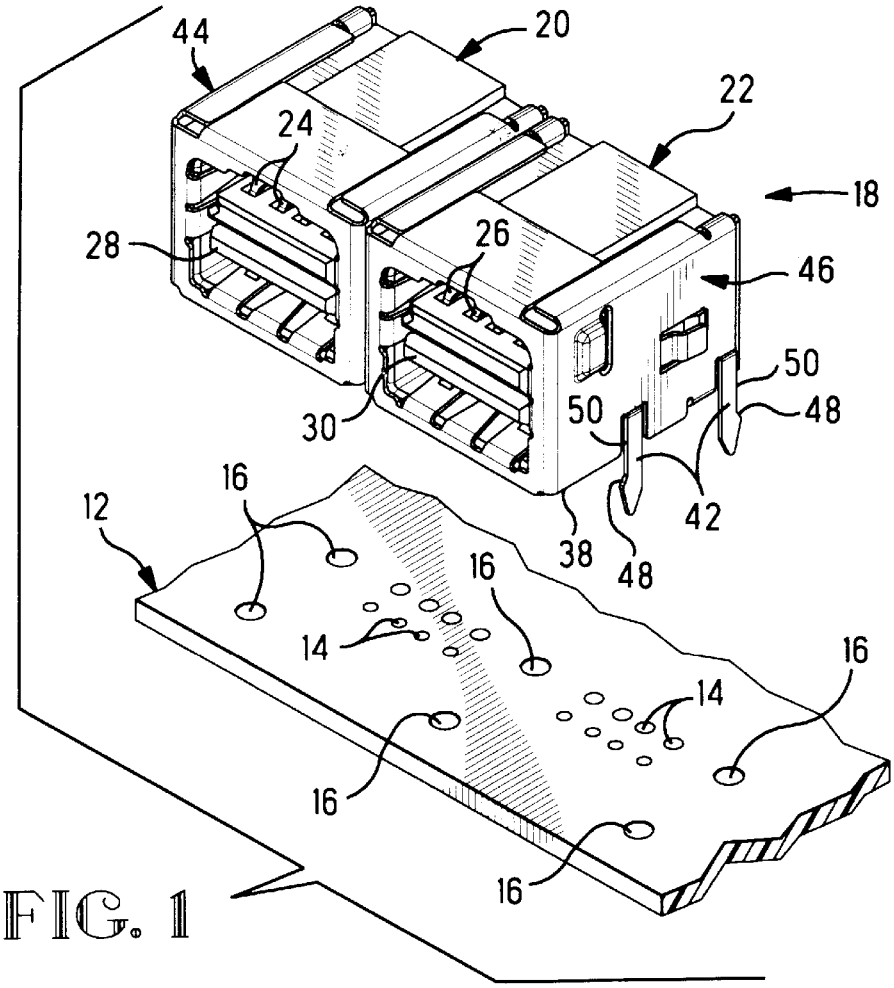
FIG. 1 is an isometric view of a pair of connectors of the present invention positioned above a circuit board for mounting thereto.
Figure 2:
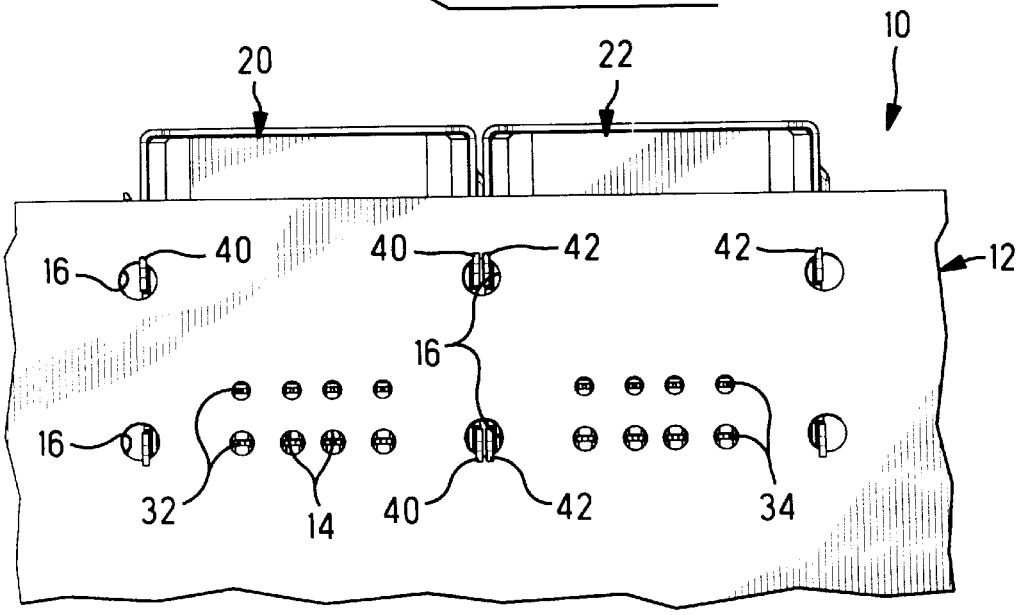
FIG. 2 is a bottom view of the circuit board with the connectors of FIG. 1 mounted thereto.
Figure 5:
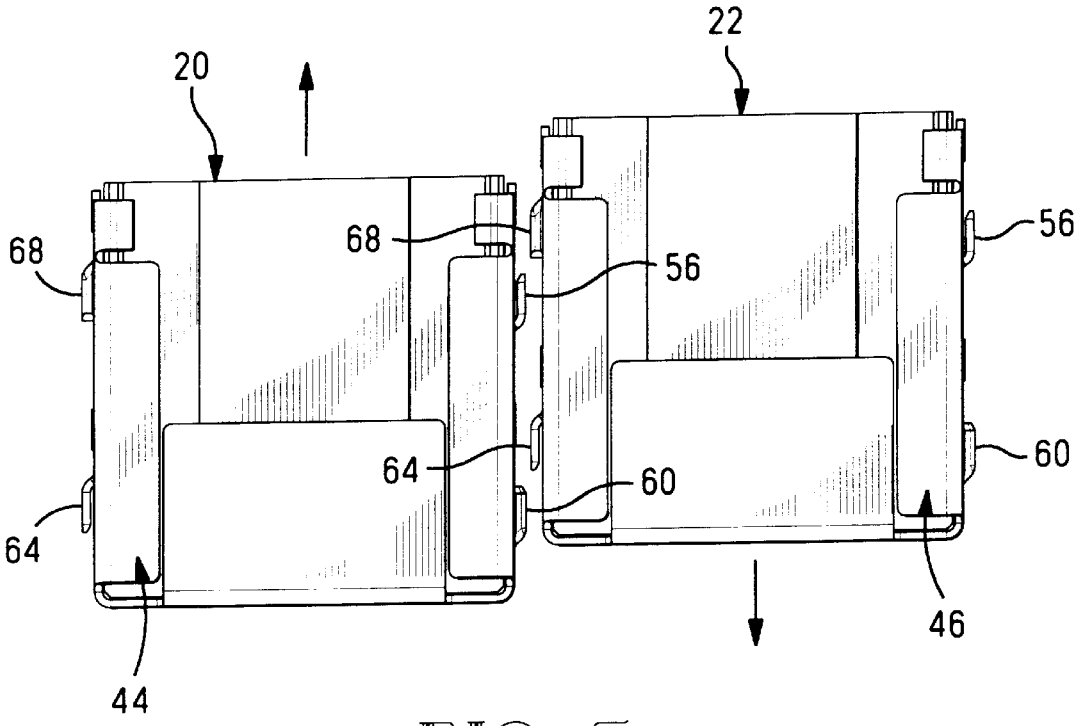
FIGS. 5 and 6 are plan views of the connectors of FIGS. 1 to 4 being interlocked to each other before and after interlocking.
Figure 6:
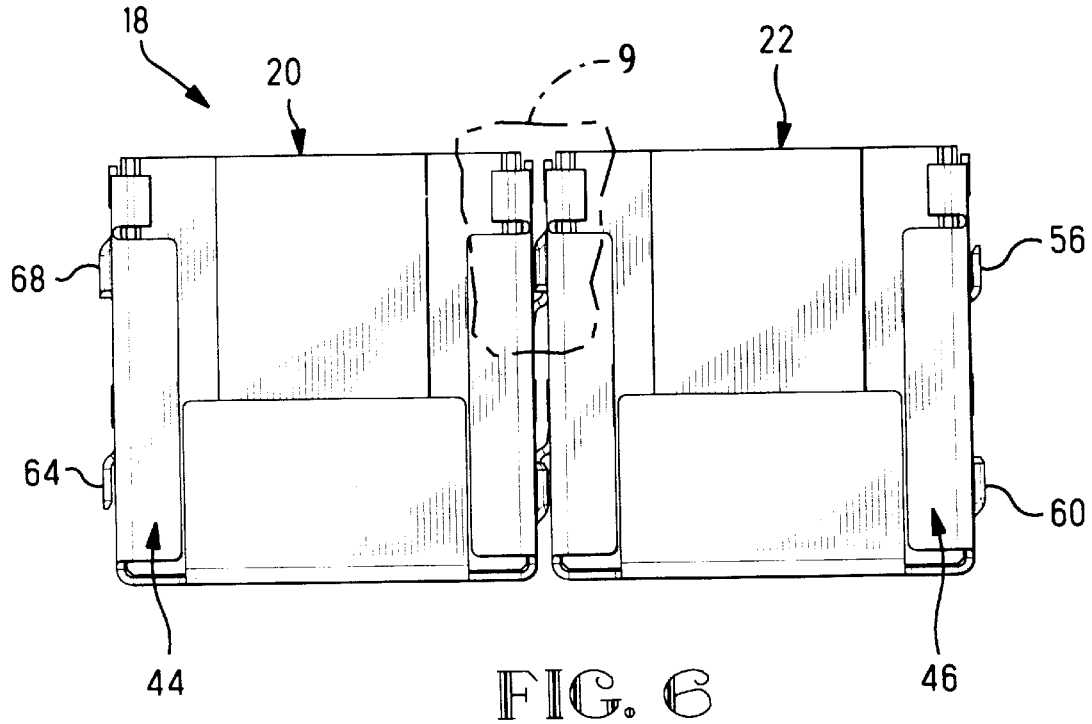
Figure 7:
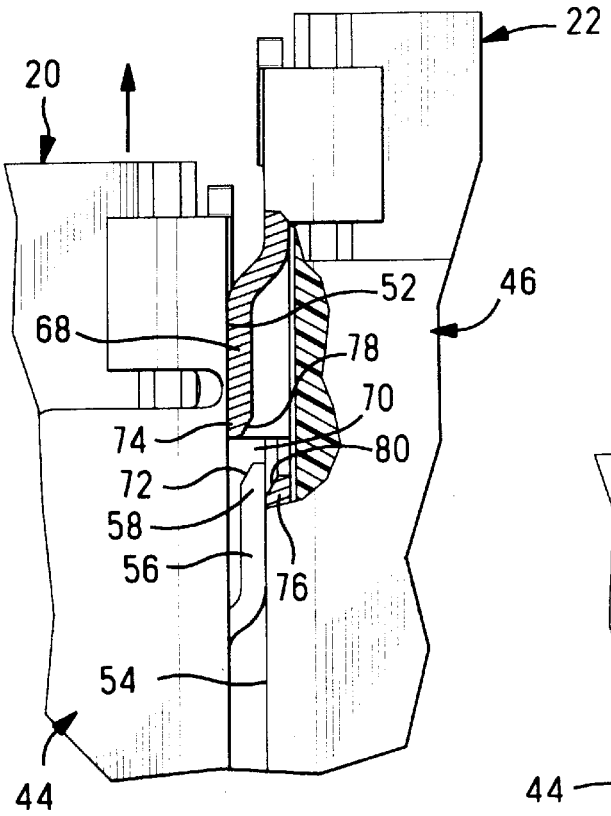
FIGS. 7 to 9 are partial enlarged views of a tab and pocket of adjacent shields prior to tab insertion, partial tab insertion and after full insertion, respectively.
Figure 8:
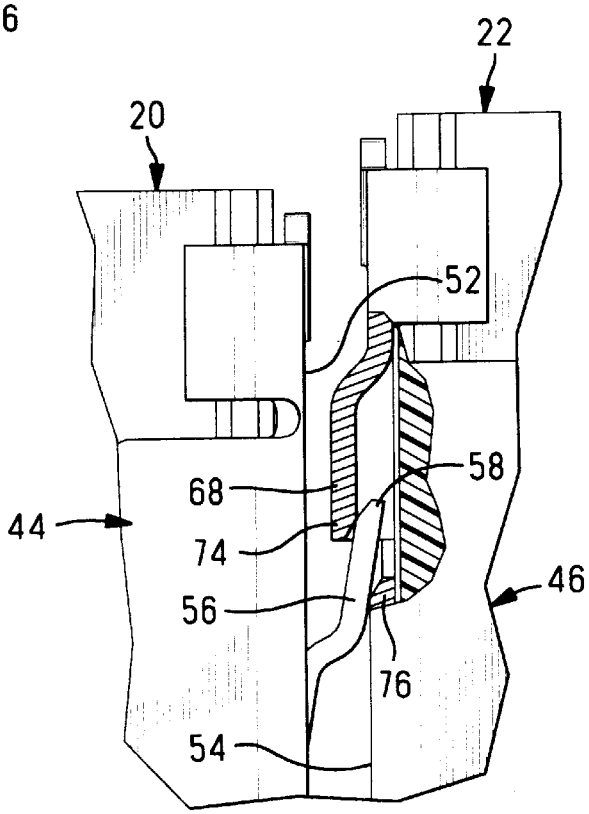
Figure 9:
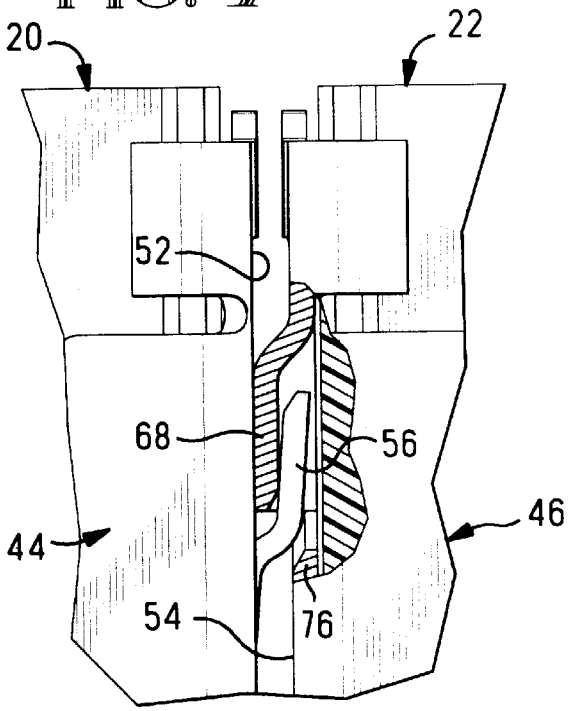

A pair of connectors 20,22 are shown in FIGS. 1 and 2 being mounted to a circuit board 12 to form a mounted side-by-side arrangement 10, with connectors 20,22 interlocked to define a connector assembly 18. Contacts 24,26 thereof are affixed within insulative housings 28,30 and include solder tails 32,34 extending below mounting faces 36,38 of the connectors to be disposed in corresponding through holes 14 of the board. Legs 40,42 of shields 44,46 similarly depend below the connector mounting faces to be disposed in corresponding mounting holes 16 of the board. Shield legs 40,42 preferably include projections 48 that extend from side edges 50 of the legs within the plane of the legs to grip the bottom surface of board 12 after passing through holes 16, as a temporary retention feature for the connectors, with the projections of the forward legs extending in the opposed direction from those of the rearward legs. The contacts will become soldered to establish assured electrical signal, power and ground connections with circuits of the board, and the shield legs 40,42 will also become soldered both to establish ground connections with the board and also to provide assured permanent board retention for the connectors.

In the first aspect of the present invention, it can be seen that the shield legs 40,42 are planar, aligned parallel to side walls of the shields and incrementally offset laterally outwardly therefrom. The legs of the shields are thus adapted to be inserted adjacent each other into common mounting holes of the board thus providing from close spacing on the board and also requiring less mounting holes to be provided on the board than has been heretofore conventionally required.

Shield 44 of connector 20 is adapted to interlock with shield 46 of connector 22, in the second aspect of the present invention, referring now to FIGS. 3 to 8. On each connector shield 44,46, since the shields are identical, the right-side shield side wall will be designated as 52, and the left-side side wall as 54. Both right-side side walls 52 are visible in FIG. 3, and both left-side side walls 54 are visible in FIG. 4.

Each right-side side wall 52 includes a locking tab 56 in a middle rearward location thereon, extending rearwardly to a free end 58, and also a tab-receiving pocket 60 in an upper forward location and having an entrance 62 facing rearwardly. Correspondingly, each left-side side wall 54 includes a locking tab 64 in an upper forward location extending forwardly to a free end 66 and a tab-receiving pocket 68 in a middle rearward location with an entrance 70 facing forwardly. The locking tabs 56,64 are struck from the respective side walls and are offset outwardly from the planes of the side walls a distance preferably just less than the thickness of the shield wall, defining deflectable beams preferably with chamfered edges 72 at leading ends 58,66 facing the shield wall, best shown in FIGS. 7 and 8. The pockets 60,66 are embossed outwardly from the planes of the respective side walls 52,54, after a slit has been cut through the shield side wall at the entrance, resulting in a gap between the pocket leading edge 74 and the opposed shield side wall edge 76 after embossment, which is entrance 62,70. Chamfers 78,80 preferably are created at the pocket leading edge and the opposed shield side wall edge.

With respect to FIGS. 5 to 9, the locking tabs 56,64 and tab-receiving pockets 60,66 define an interlocking arrangement to lock together the two shields side-by-side when one thereof is translated from an adjacent but offset position to an aligned position causing the locking tabs of each to enter corresponding pockets of the other along the facing left-side side wall of one and the right-side side wall of the other. Additional similar connectors may be likewise added to the assembly, if desired. The locking tabs and pockets cooperate with each other for their planes to "overlap" such that their laterally offset distances are not cumulative between the connectors, and the shield side walls contain are free of any other projections that would otherwise interfere with the shield legs being alongside each other closely enough to be inserted into the same mounting holes during board mounting.

Chamfered surfaces 72 of locking tab free ends 58,66 bear against chamfered surfaces 78 upon initial entry into entrances 70 of pockets 60,68 forcing deflection of the leading portion of the locking tab until the outer surface bears against chamfered surfaces 78 of opposed shield wall side edges 76. The locking tabs become deflected until fully inserted into the pockets, whereafter the locking tabs relax or resile into an orientation substantially parallel to the shield side walls. The dimensions may be selected such that locking tabs of each shield urge the walls of the associated pockets against the shield side wall adjacent to the locking tabs, and after insertion continue to bias the pockets against the shield side walls and thereby establish a friction fit sufficient to prevent inadvertent separation of the interlocked connectors.

The present invention provides for close spacing of shielded connectors on a circuit board and also for the connectors to be assembled to each other and manipulated as a unit for board mounting.

What is claimed is:

1. An arrangement of at least two electrical connectors mounted on a circuit board side-by-side, comprising:

at least a first and a second electrical connector each having an insulative housing containing at least one electrical contact having a board-connecting section extending from a mounting face of the housing, and each further having a shield generally surrounding the housing that is adapted to permit the board-connecting section to extend therebeyond, and a circuit board including at least two connector sites side-by-side with each site including a contact-connecting section associated with each said contact of a respective said connector, said shields of said first and second connectors when positioned adjacent each other, having first and second generally planar side walls opposite each other, and said shields having at least one board-mounting leg depending from a bottom edge of said first and second side walls extending beyond said board mounting faces such that said at least one board-mounting leg is adjacent a corresponding said board-mounting leg of the other shield when said connectors are positioned side-by-side, each said at least one board-mounting leg of one said shield being generally planar and parallel to said first and second side walls, and extends alongside said corresponding board-mounting leg of the other shield defining a pair of adjacent ones of said board-mounting legs, and said circuit board having a single mounting hole associated with each said pair of adjacent ones of said board-mounting legs of said first and second shields of adjacent side walls thereof, whereby said board-mounting legs of said first and second shields of adjacent side walls thereof are inserted into single mounting holes of the board when the connectors are mounted thereto side-by-side.

2. The arrangement as set forth in claim 1 wherein each said first and second side wall includes two said board-mounting legs, thus defining two pairs of adjacent ones of said board-mounting legs inserted into respective ones of single mounting holes of said board.

3. An arrangement of at least two connectors interlocked to each other, comprising:

at least a first and second electrical connector interlocked to each other along facing side walls in a side-by-side arrangement and manipulatable as a unit, each said connector including an insulative housing having at least one electrical contact contained therewithin;

said first connector including a first shield generally surrounding said housing thereof, said first shield having a first side wall and a second side wall, and said second connector including a second shield generally surrounding said housing thereof, said second shield having a first side wall and a second side wall with said first side wall of said first shield facing said second side wall of said second shield;

said first side wall including a locking tab and a tab-receiving pocket at respective locations offset vertically and horizontally from each other in a first pattern with said locking tab offset outwardly from and extending parallel to said first side wall in a first direction and said tab-receiving pocket having an entrance facing in said first direction; and said second side wall including a locking tab and a tab-receiving pocket at respective locations offset vertically and horizontally from each other in a second pattern complementary to said first pattern, with said locking tab offset outwardly from and extending parallel to said second side wall in a second direction opposite said first direction and said tab-receiving pocket having an entrance facing in said second direction, whereby said first and second connectors are interlocked side-by-side with said locking tab of said first side wall received in said tab-receiving pocket of said second side wall and said locking tab of said second side wall received in said tab-receiving pocket of said first side wall.

4. The arrangement as set forth in claim 3 wherein said tab-receiving pockets are embossed outwardly from respective said side walls.

5. The arrangement as set forth in claim 4 wherein said entrances to said tab-receiving pockets are defined by a gap between leading ends of said pockets and opposed edges of respective said shield side walls in a direction parallel to said shield side walls.

6. The arrangement as set forth in claim 4 wherein said locking tabs are parallel to and offset outwardly from respective shield side walls a distance just less than a thickness of a respective said tab-receiving pocket.

7. The arrangement as set forth in claim 3 wherein board-mounting legs of said first side wall coextend alongside and adjacent to board-mounting legs of said second side wall defining pairs thereof depending together from board-mounting faces of said first and second connectors.

8. The arrangement as set forth in claim 7 wherein each said board-mounting leg includes a projection from a side edge thereof adapted to lock with a circuit board upon said board-mounting leg passing through a mounting hole of said board, to retain said arrangement on said board.

9. An electrical connector comprising:

an insulative housing containing at least one electrical contact, and further including a shield generally surrounding said housing, said shield including first and second side walls, said first side wall including a locking tab and a tab-receiving pocket at respective locations offset vertically and horizontally from each other in a first pattern with said locking tab offset outwardly from and extending parallel to said first side wall in a first direction and said tab-receiving pocket having an entrance facing in said first direction; and said second side wall including a locking tab and a tab-receiving pocket at respective locations offset vertically and horizontally from each other in a second pattern complementary to said first pattern, with said locking tab offset outwardly from and extending parallel to said second side wall in a second direction opposite said first direction and said tab-receiving pocket having an entrance facing in said second direction, whereby said connector is adapted to be interlocked side-by-side on either or both sides with a like connector with said locking tab of said first side wall of said connector received in said tab-receiving pocket of said second side wall of said like connector and said locking tab of said second side wall of said like connector received in said tab-receiving pocket of said first side wall of said connector.

10. The connector as set forth in claim 9 wherein said tab-receiving pockets are embossed outwardly from respective said side walls.

11. The connector as set forth in claim 10 wherein said locking tabs are parallel to and offset outwardly from respective shield side walls a distance just less than a thickness of a respective said tab-receiving pocket.

12. The connector as set forth in claim 11 wherein said entrances to said tab-receiving pockets are defined by a gap between leading ends of said pockets and opposed edges of respective said shield side walls in a direction parallel to said shield side walls.

13. The connector as set forth in claim 9 wherein board-mounting legs depend from bottom edges of said first and second side walls, whereby said board-mounting legs of one of said first and second side walls will coextend alongside and adjacent, to board-mounting legs of said like connector defining pairs thereof depending together from board-mounting faces thereof.

14. The connector as set forth in claim 13 wherein each said board-mounting leg includes a projection from a side edge thereof adapted to lock with a circuit board upon said board-mounting leg passing through a mounting hole of said board, to retain said connector on said board.

* * * * *